US007748703B2

(12) United States Patent
Schererz et al.

(10) Patent No.: US 7,748,703 B2
(45) Date of Patent: Jul. 6, 2010

(54) DEVICE FOR STACKING FLAT, FLEXIBLE POSTAL ITEMS IN A STACKING COMPARTMENT

(75) Inventors: Holger Schererz, Rehfelde (DE); Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 289 days.

(21) Appl. No.: 10/590,757

(22) PCT Filed: Jan. 21, 2005

(86) PCT No.: PCT/EP2005/000575

§ 371 (c)(1),
(2), (4) Date: Jun. 8, 2007

(87) PCT Pub. No.: WO2005/082754

PCT Pub. Date: Sep. 9, 2005

(65) Prior Publication Data

US 2007/0290428 A1 Dec. 20, 2007

(30) Foreign Application Priority Data

Feb. 28, 2004 (DE) ..... 10 2004 009 798

(51) Int. Cl.
*B65H 29/70* (2006.01)

(52) U.S. Cl. ..... 271/188; 271/209

(58) Field of Classification Search ..... 271/188, 271/209

See application file for complete search history.

(56) References Cited

U.S. PATENT DOCUMENTS 3,545,371 A 12/1970 Reist
4,406,648 A 9/1983 Cavagna et al.
4,564,189 A 1/1986 Noll, Jr.
4,657,241 A 4/1987 Frank
5,209,466 A * 5/1993 Watts et al. ..... 271/188
5,555,083 A * 9/1996 Kuo et al. ..... 399/406
5,683,079 A * 11/1997 Ebrahimi ..... 271/258.01
5,820,122 A * 10/1998 Schneider ..... 271/188
5,931,455 A * 8/1999 Okui et al. ..... 271/127
6,012,715 A * 1/2000 Kasahara ..... 271/186

(Continued)

FOREIGN PATENT DOCUMENTS

DE 6 609 089 U 2/1972

(Continued)

*Primary Examiner*—Patrick Mackey
*Assistant Examiner*—Michael C McCullough
(74) *Attorney, Agent, or Firm*—Laurence A. Greenberg; Werner H. Stemer; Ralph E. Locher

(57) ABSTRACT

A device for stacking flat, flexible postal items in a stacking compartment in an upright position includes a stacking roller positionable in proximity of the stacking compartment. A covered belt system feeds the postal items consecutively to the stacking roller, wherein the belt system has a first belt and a second belt. A deflection roller on an axis deflects the first belt from the second belt so that the second belt continuous to transport a postal item to the stacking roller. A first profile roller on the deflection roller has a predetermined roller length and includes a number of diameter taperings over its roller length. Deflectable pressure means press the postal items into the diameter taperings of the first profile roller to reduce a free flexible lengths of a postal items.

7 Claims, 3 Drawing Sheets

U.S. PATENT DOCUMENTS

2004/0084836 A1 5/2004 Lindenmayer et al.

FOREIGN PATENT DOCUMENTS

DE 3138454 A1 9/1982
DE 35 26 306 A1 1/1987
DE 101 18 758 C1 5/2002
EP 0 038 918 A 11/1981
FR 2686868 A1 * 8/1993

* cited by examiner

DEVICE FOR STACKING FLAT, FLEXIBLE POSTAL ITEMS IN A STACKING COMPARTMENT

BACKGROUND OF THE INVENTION

The invention relates to a device for stacking flat, flexible postal items in a stacking compartment.

Such stacking compartments are for example components of sorting compartment lines in postal item sorting installations. Postal items are distributed according to the destination addresses into the assigned stacking compartments via a transport path with points-type switches. To achieve a high throughput of the sorting installations, the distances between the postal items (item gaps) are selected to be as small as possible. If different types of items (e.g. thin, unstable, tall postal items, open magazines) are to be stacked they are to be put into a state whereby they pass on a largely unsupported path between the last clamping point of the transport path and the stacking roller without the open postal items being blown open by the wind caused by their movement and thereby being folded or damaged during stacking. Furthermore the tall, unstable postal items are to be stabilized so that they do not collide with the postal items already stacked.

A stacking device is described in the prior art (EP 0 127 067 A1), which possesses a so-called beaded roller as the deflection roller of the shorter covered belt. This beaded roller, which is longer than the width of the covered belt, has a bead at each end. Since the moving belt of the covered belt system presses the postal item in its center against the beaded roller and the outer parts of the item are in contact with the beads in this case, a flexible item is bent and thus stabilized, so that it does not deform when routed on one side into the stacking compartment. Thus a lengthwise reinforcement for stabilization can be only be achieved for short unstable items. Tall unstable and open postal items cannot be stacked securely and without problems using this method.

SUMMARY OF THE INVENTION

The object of the invention is to create a device for stacking flat, flexible postal items in a stacking compartment in an upright position with the open postal items bound on one side, such as magazines, being able to be fed and stacked on one side securely and with few problems, without being opened out by the wind caused by their movement.

In accordance with the invention one aspect involves a device for stacking flat, flexible postal items in a stacking compartment in an upright position includes a stacking roller positionable in proximity of the stacking compartment. A covered belt system feeds the postal items consecutively to the stacking roller, wherein the belt system has a first belt and a second belt. A deflection roller on an axis deflects the first belt from the second belt so that the second belt continuous to transport a postal item to the stacking roller. A first profile roller on the deflection roller has a predetermined roller length and includes a number of diameter taperings over its roller length. Deflectable pressure means press the postal items into the diameter taperings of the first profile roller to reduce a free flexible lengths of a postal items.

A profile roller having several diameter taperings arranged over the length of the roller is disposed on the axis and above the deflection roller of the short belt of the covered belt system. Deflectable pressing means which press the postal items into the taperings of the profile roller by means of a spring force are arranged on the profile roller, which impart to the flexible postal items a stiffening undulating profile. So that the upper edges of the postal items with the permitted item formats to do not protrude beyond a defined maximum height above the highest tapering covered by the relevant item, the taperings of the profile roller are distributed accordingly over the length of the roller.

This shortens the free flexible lengths of the angular flexible individual sheets so that the air resistance operating on them during the stacking does not cause them to bend. The danger of opening out relates above all to the upper corners of the leaves in the direction of conveyance.

Advantageous embodiments of the invention are set down in the subclaims.

It is thus advantageous to provide as a pressure means narrow deflectable pressure rollers pressing with spring pressure against the taperings of the profile roller with the smaller diameter.

In a further embodiment of the pressure means a second profile roller with the same profile can be arranged so that the diameter taperings of the one profile roller are located at the height of the untapered sections of the other profile roller.

It is also advantageous to select the pressure force of the pressure means to be just great enough for stiffer postal items not to be damaged by forced deformation.

BRIEF DESCRIPTION OF THE SEVERAL VIEWS OF THE DRAWINGS

The invention is explained below in an exemplary embodiment with reference to the drawing.

The figures show

DETAILED DESCRIPTION OF THE INVENTION

Figure 1:
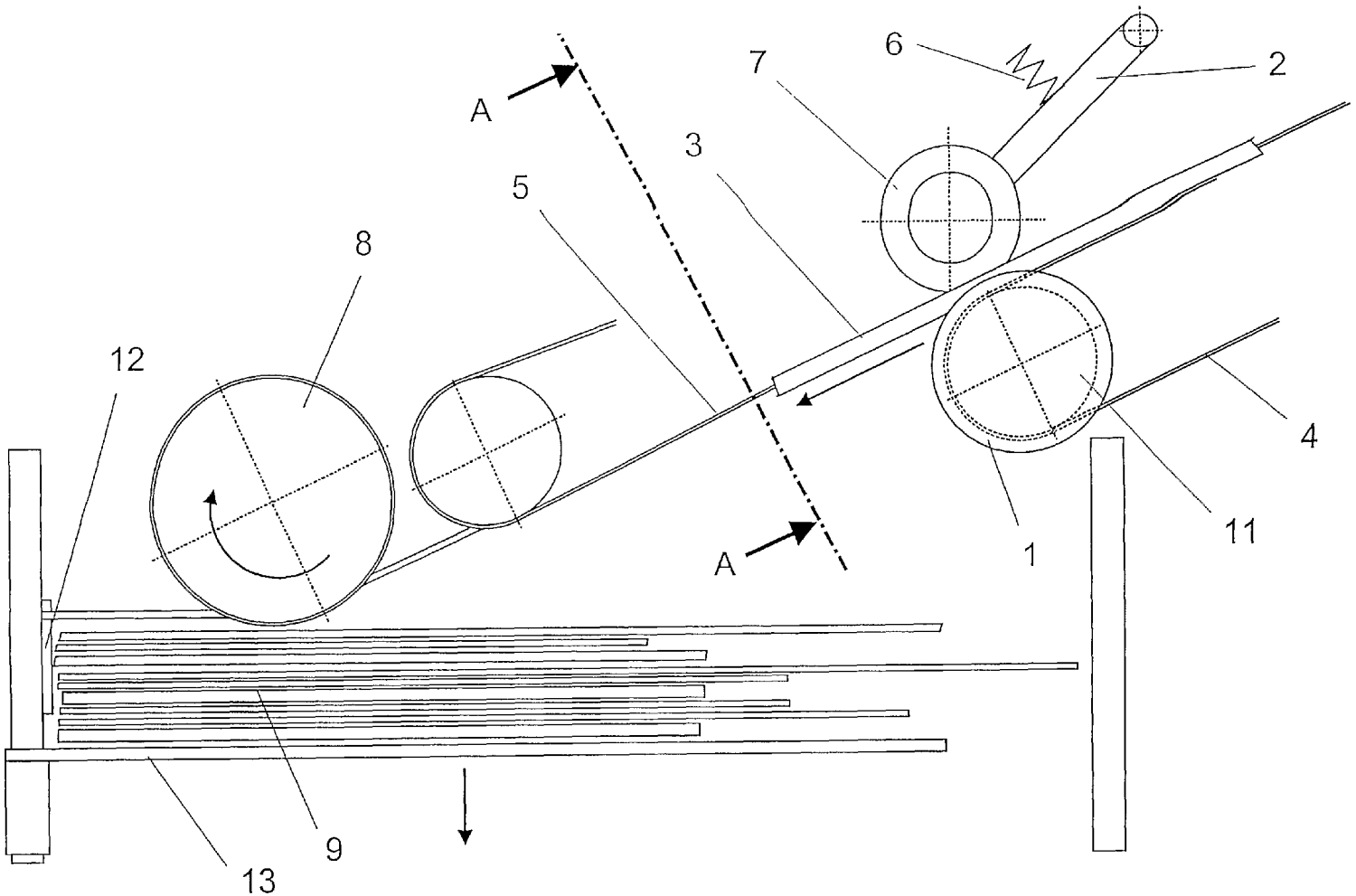
FIG. 1 a schematic view from above of the stacking device and the stacking compartment, FIG. 2 a side view of a profile roller with two pressure rollers.
Figure 2:
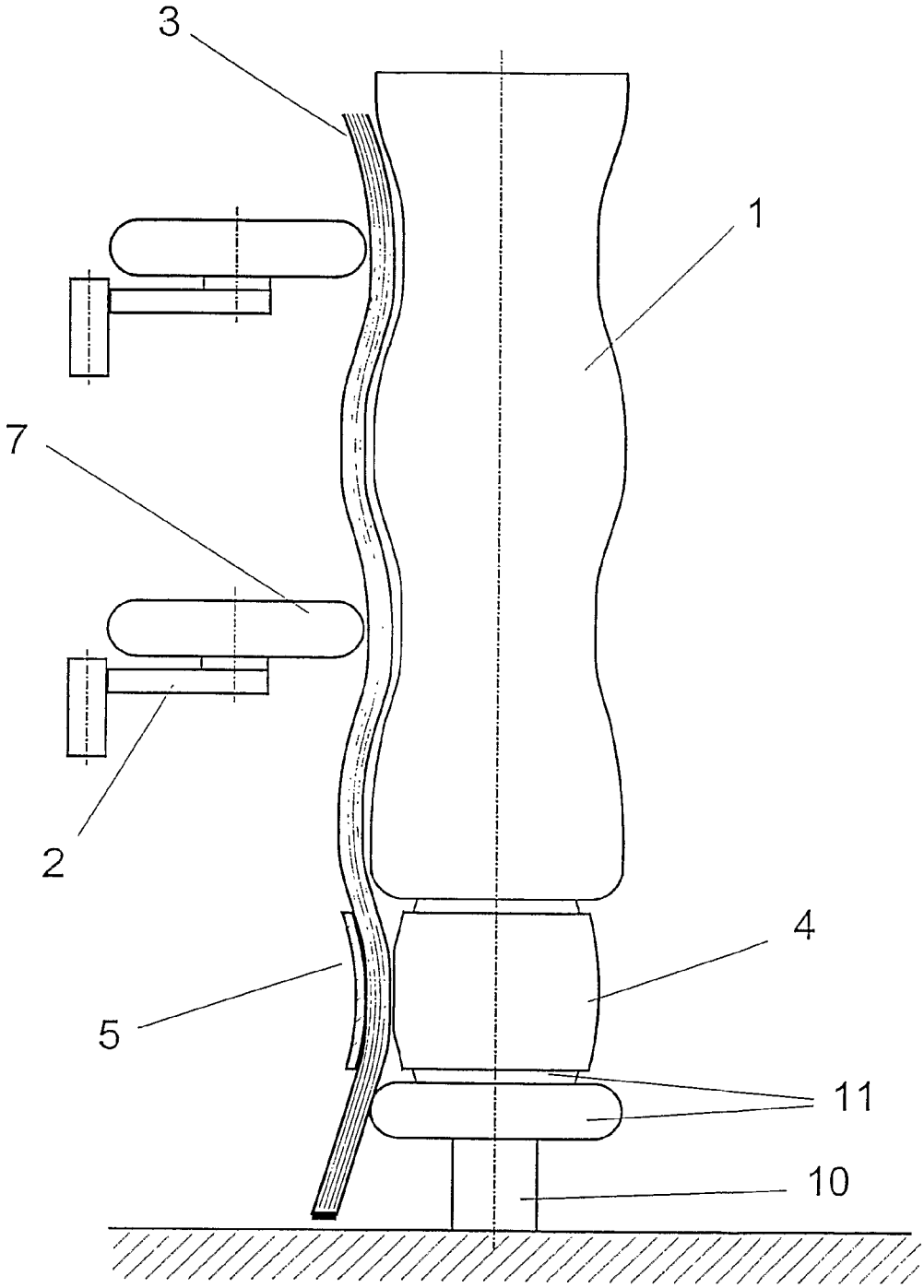
Figure 3:
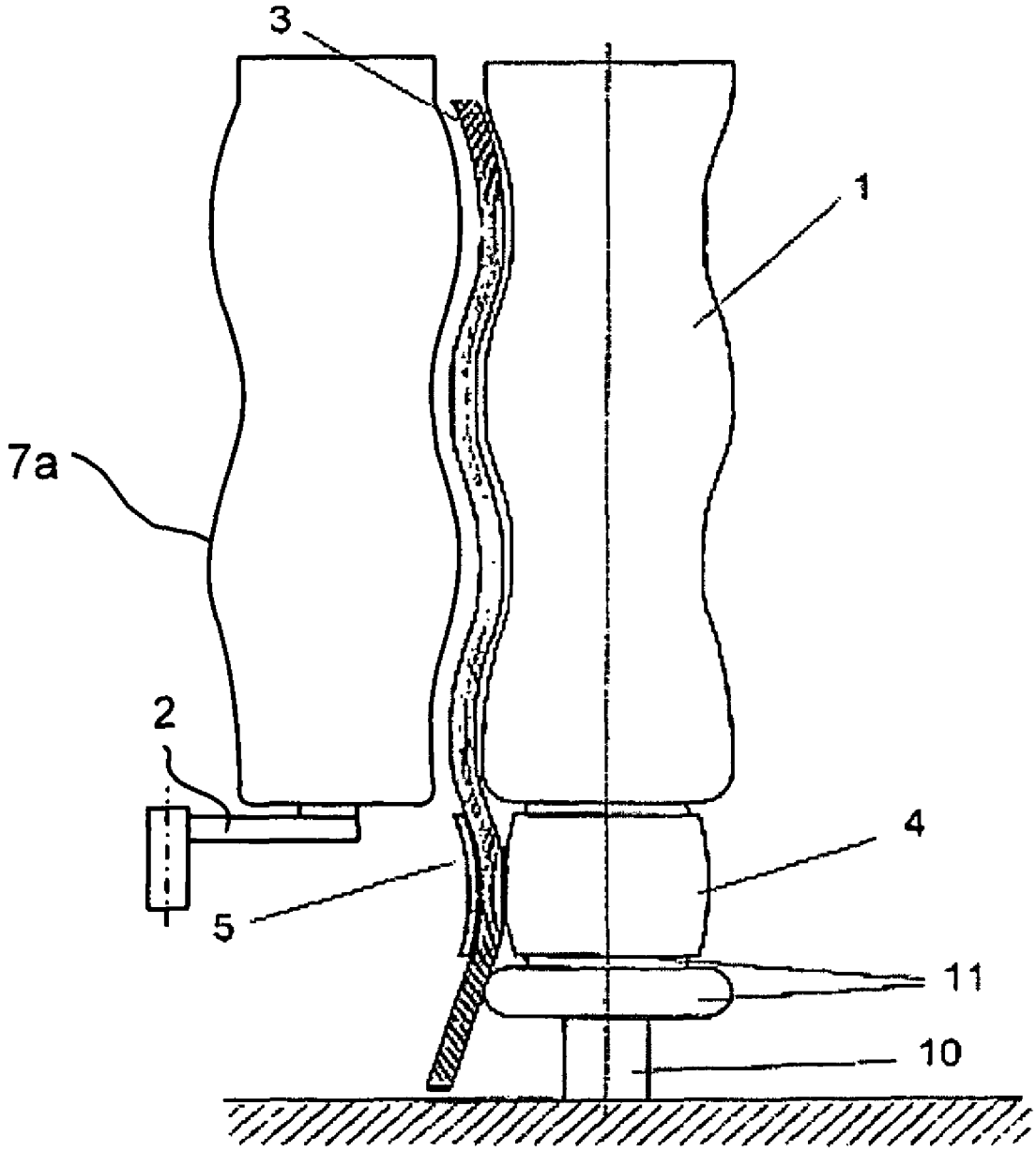
FIG. 3 is a side view of a profile roller with one pressure roller.

For the sake of clarity the stacking compartment is not shown completely in FIG. 1 but is only shown with the components required to explain its function. The flat postal items 3 are fed at an angle to the stacking compartment in a horizontal position, clamped between two relatively narrow driven belts 4, 5 of a covered belt system. At the entry to the stacking compartment the belt 4 lying on the stack side is fed back over a deflection roller 11 so that the postal item 3 to be stacked is free on this side and can be stacked. The postal item 3 is then directed on one side by the other belt 5 to a stacking roller 8. At this stacking roller 8 the postal item arriving at an angle to the stacking device is bent around in a parallel orientation to the stacked postal items of the stack 9 and transported to a stop wall 12. For each new stacked postal item 3 a stack support 13 holding the stack will move away from the stacking roller 8, so that space is again created for a new postal item 3.

On the paths to the stacking roller 8 open, multi-page postal items bound on one side, e.g. open magazines with only slight inherent stiffness at a relatively high stacking speed as a result of the air resistance on stacking can be opened up with the bound side downwards. To reduce the free flexible lengths of the magazines of different formats to prevent the opening out of the sheets, the postal items 3 with sufficient elasticity are given a cross-sectional profile by means of profile roller 1 located on the axis 10 of the deflection roller 11 and above it (which is the case with open magazines). The deflection roller 11 known per se has a bead at the bottom so that the postal item 3 pressed by the belt 5 of the covered belt system onto the deflection roller 11 is bent away in the lower part from the deflection roller 11. Since this does not give the large postal items 3 any stability, the profile roller 1 with the undulating tapered profile is located over the deflection roller 11. So that the postal items 3 assume this profile curve over their height they must at least be pressed onto the tapered areas of the profile roller 1.

This is done here by narrow pressure rollers 7 pivotable on a hinged arm 2 being supported on the profile roller at the height of these tapered areas and being pressed by means of a spring 6 engaging on the hinged arm 2 against the profile roller 1. This gives the postal items 3 this profile. This pressure can also be applied by using a profiled pressure roller 7*a*, with the taperings of this pressure roller 7*a* being located at the height of the areas with the greater diameters of profile roller 1.

How many taperings the profile roller 1 possesses and the points over the length of the roller at which they are distributed also depends on the range of postal item formats to be processed. Since it has transpired that the danger of opening out of open postal items 3 bound on one side (binding edge downwards) above all occurs in the direction of conveyance of front top corners, the undulation spacing in the upper area of the postal items 3 of the range of postal items is selected such that the resulting maximum free bending length is so small that no opening out occurs on the way to the stacking roller 8. The undulation spacing thus does not have to be the same over the height/length of the profile roller 1.

The invention claimed is:

1. A device for stacking flat, flexible postal items in a stacking compartment in an upright position, comprising:

a stacking roller positionable in proximity of the stacking compartment;

a covered belt system configured to feed the postal items consecutively to the stacking roller, wherein the belt system has a first belt and a second belt;

a deflection roller disposed on an axis and configured to deflect the first belt from the second belt so that the second belt continues to transport a postal item to the stacking roller;

a profile roller arranged on the deflection roller and having a predetermined roller length, wherein the profile roller includes a plurality of diameter taperings over a length thereof; and deflectable pressure means disposed to press the postal items into the plurality of diameter taperings of the profile roller to reduce a free flexible length of each of the postal items.

2. The device of claim 1, wherein the plurality of diameter taperings of the profile roller are distributed over the roller length so that upper edges of the postal items of a permitted item format do not protrude beyond a defined maximum dimension so that an opening of a postal item is avoided above a highest tapering covered by the postal item.

3. The device of claim 1, wherein the deflectable pressure means include deflectable pressure rollers, which can be pressed with spring pressure against the plurality of diameter taperings of the profile roller, and wherein the pressure rollers have smaller diameters than the plurality of diameter taperings of the profile roller.

4. The device of claim 1, wherein the deflectable pressure means include a profiled pressure roller having a profile that corresponds to a profile of the profile roller, wherein the profiled pressure roller is disposed such that diameter taperings thereof of are located at heights of untapered sections of the profile roller.

5. The device of claim 1, wherein a pressure force of the deflectable pressure means is selected to avoid damaging stiff postal items by deforming them.

6. The device of claim 1, wherein each of the plurality of diameter taperings extend in a circumferential direction about the profile roller.

7. The device of claim 1, wherein the deflectable pressure means include spring-biased deflectable pressure rollers, each of the plurality of diameter taperings having a respective one of the spring-biased deflectable rollers disposed opposite thereto.

* * * * *